US006681430B2

(12) United States Patent
Stalsberg

(10) Patent No.: US 6,681,430 B2
(45) Date of Patent: Jan. 27, 2004

(54) METHOD AND SYSTEM FOR MECHANIZING SIMULTANEOUS MULTI-ACTUATOR ACTIONS APPLIED TO DYNAMIC BALANCING

(75) Inventor: Kevin J. Stalsberg, White Bear Lake, MN (US)

(73) Assignee: Honeywell International Inc., Morristown, NJ (US)

( * ) Notice: Subject to any disclaimer, the term of this patent is extended or adjusted under 35 U.S.C. 154(b) by 142 days.

(21) Appl. No.: 10/000,255

(22) Filed: Nov. 15, 2001

(65) Prior Publication Data

US 2003/0167577 A1 Sep. 11, 2003

(51) Int. Cl.[7] ..... D06F 33/02

(52) U.S. Cl. ..... 8/159; 68/12.06; 68/23.5; 68/23.2; 68/23.3; 74/573 F; 210/144

(58) Field of Search ..... 68/23.2, 23.3, 68/23.5, 12.06; 74/573 F; 210/144; 8/158, 159

(56) References Cited

U.S. PATENT DOCUMENTS

| | | | | |
|---|---|---|---|---|
| 3,799,348 A | | 3/1974 | Mazza | 210/144 |
| 3,983,035 A | | 9/1976 | Arkeveld et al. | 210/138 |
| 4,000,658 A | | 1/1977 | Schmidt | 73/490 |
| 4,157,781 A | | 6/1979 | Maruyama | 233/23 A |
| 4,322,641 A | | 3/1982 | Packard | 307/521 |
| 4,432,253 A | * | 2/1984 | Kerlin | |
| 4,537,177 A | * | 8/1985 | Steere, Jr. et al. | |
| 4,694,156 A | | 9/1987 | Swanberg | 250/214 |
| 4,991,247 A | * | 2/1991 | Castwall et al. | |
| 5,150,314 A | | 9/1992 | Garratt et al. | 364/571.02 |
| 5,280,660 A | | 1/1994 | Pellerin et al. | 8/158 |
| 5,325,677 A | | 7/1994 | Payne et al. | 68/12.04 |
| 5,343,408 A | * | 8/1994 | Chen | |
| 5,376,063 A | | 12/1994 | Greenstein | 494/37 |
| 5,490,436 A | | 2/1996 | Coyne et al. | 74/573 |
| 5,561,993 A | | 10/1996 | Elgersma et al. | 68/23.2 |
| 5,582,040 A | | 12/1996 | Khan | 68/23.2 |
| 5,692,313 A | | 12/1997 | Ikeda et al. | 34/58 |
| 5,715,731 A | | 2/1998 | Koch | 74/573 |
| 5,729,025 A | | 3/1998 | Erickson et al. | 250/574 |
| 5,731,868 A | | 3/1998 | Okey et al. | 356/73 |
| 5,757,481 A | | 5/1998 | O'Brien et al. | 356/243 |

(List continued on next page.)

FOREIGN PATENT DOCUMENTS

| | | | | |
|---|---|---|---|---|
| EP | 1 036 875 A2 | | 9/2000 | D06F/39/08 |
| JP | 57-76341 | * | 5/1982 | |

*Primary Examiner*—Frankie L. Stinson
(74) *Attorney, Agent, or Firm*—Kris T. Fredrick; Luis M. Ortiz; Kermit D. Lopez

(57) ABSTRACT

A method and system for dynamically balancing a rotating system based on a plurality of simultaneous and discrete control actions that place mass at predetermined locations within the rotating system so as to achieve balance is disclosed. A balance control algorithm may be utilized to provide a desired control action regarding an amount of mass to be placed, the extent each discrete action contributes, and the location of placement on the rotating system. The control action is broken down into subsets of discrete actuator steps whose whole will accomplish the desired control action. The composition of the actuator step subsets is based on particular ratios and limits and evolve based on the portion of the action already accomplished. A plurality of control actuators is simultaneously activated to deploy the discrete control actuator actions that place mass at predetermined locations within the rotating system. The subsets of discrete control actuator actions can be applied in a manner that most closely resembles a continuous placement of mass so as to smoothly place the rotating system in a balanced state, thereby mechanizing simultaneous and discrete control actuations within the rotating system.

20 Claims, 7 Drawing Sheets

U.S. PATENT DOCUMENTS 5,761,932 A 6/1998 Kim ..... 68/23.2
5,761,933 A 6/1998 Kim et al. ..... 68/23.2
5,765,402 A 6/1998 Ikeda et al. ..... 68/12.06
5,800,628 A 9/1998 Erickson et al. ..... 134/18
5,850,748 A 12/1998 Kim et al. ..... 68/23.2
5,862,553 A 1/1999 Haberl et al. ..... 8/159
5,870,907 A 2/1999 Cho ..... 68/23.1
5,893,280 A 4/1999 Honda et al. ..... 68/12.06
5,913,951 A 6/1999 Herr et al. ..... 8/158
5,921,148 A 7/1999 Howell ..... 74/573
5,923,433 A 7/1999 Giuffre et al. ..... 356/440
5,957,144 A 9/1999 Neff et al. ..... 134/56 D
5,960,804 A 10/1999 Cooper et al. ..... 134/56 D
5,979,236 A 11/1999 Hong et al. ..... 73/458
6,007,640 A 12/1999 Neff et al. ..... 134/18
6,029,300 A 2/2000 Kawaguchi et al. ..... 8/159
6,047,428 A 4/2000 Min ..... 8/159
6,077,423 A 6/2000 Roy et al. ..... 210/121
6,082,151 A 7/2000 Wierzba et al. ..... 68/23.2
6,129,768 A 10/2000 Johnson et al. ..... 8/159
6,130,928 A 10/2000 Jamzadeh et al. ..... 377/23
6,144,447 A 11/2000 Ohman et al. ..... 356/246
6,148,647 A 11/2000 Kabeya et al. ..... 68/140
6,159,384 A 12/2000 Roberts et al. ..... 210/741
6,418,758 B1 * 7/2002 Ikeda et al.
6,510,715 B1 * 1/2003 Simsek

* cited by examiner

350

| | 352 Front Control plane | 354 Back Control plane | 356 y-ratio | 358 x | 360 x' | 362 *FThrNo* | 364 *BThrNo* |
|---|---|---|---|---|---|---|---|
| **Desire Action** | 22 | 4 | 5.5 | .846 | 4/5 | 4 | 1 |
| **Threshold-limited Action** | -4 | -1 | | | | | |
| **Next Desire Action** | 18 | 3 | 6 | .857 | 4/5 | 4 | 1 |
| **Next Threshold-limited Action** | -4 | -1 | | | | | |
| **Next Desire Action** | 14 | 2 | 7 | .875 | 4/5 | 4 | 1 |
| **Next Threshold-limited Action** | -4 | -1 | | | | | |
| **Next Desire Action** | 10 | 1 | 10 | .909 | 5/5 | 5 | 0 |
| **Next Threshold-limited Action** | -5 | -0 | | | | | |
| **Next Desire Action** | 5 | 1 | 5 | .833 | 4/5 | 4 | 1 |
| **Next Threshold-limited Action** | -4 | -1 | | | | | |
| **Next Desire Action** | 1 | 0 | 1 | Below Balance Threshold Limit | | | |
| **Next Threshold-limited Action** | 1 | 0 | | | | | |
| **Next Desire Action** | 0 | 0 | 0 | | | | |

*Fig. 8*

METHOD AND SYSTEM FOR MECHANIZING SIMULTANEOUS MULTI-ACTUATOR ACTIONS APPLIED TO DYNAMIC BALANCING

RELATED APPLICATIONS

This application is related to patent applications entitled: 'Method and Apparatus for Reducing Microprocessor Speed Requirements in Data Acquisition Applications,' U.S. Ser. No. 09/792,996, filed on Feb. 26, 2001; now U.S. Pat. No. 6,502,789, 'Method and System for Detecting Fluid Injection from Stationary to Rotating Members,' U.S. Ser. No. 09/951,790, filed on Sep. 10, 2001; 'Simultaneous Injection Method and System for a Self-Balancing Rotatable Apparatus,' U.S. Ser. No. 09/896,763, filed on Jun. 29, 2001; now U.S. Pat. No. 6,532,421, 'Energy-Based Thresholds Applied to Dynamic Balancing,' U.S. Ser. No. 09/951,798, filed on Sep. 10, 2001; 'Dynamic Correlation Extension for a Self-Balancing Rotatable Apparatus' U.S. Ser. No. 09/951,932, filed on Sep. 10, 2001; 'Continuous Flow Method and System for Placement of Balancing Fluid on a Rotating Device Requiring Dynamic Balancing', U.S. Ser. No. 10/001,006, filed on Nov. 15, 2001; 'Dynamic Balancing Application Mass Placement', U.S. Ser. No. 10/001,090, filed on Nov. 15, 2001; 'Fixed-Bandwidth Correlation Window Method and System for a Self-Balancing Rotatable Apparatus,' U.S. Ser. No. 09/999,594, filed on Nov. 15, 2001; 'Supervisory Method and System for Improved Control Model Updates Applied to Dynamic Balancing,' U.S. Ser. No. 10/011,218, filed on Nov. 15, 2001; 'Data Manipulation Method and System for a Self-Balancing Rotatable Apparatus,' U.S. Ser. No. 10/000,882, filed on Nov. 15, 2001; 'Resonance Identification Extension for a Self-Balancing Rotatable Apparatus,' U.S. Ser. No. 10/001,098, filed on Nov. 15, 2001, now U.S. Pat. No. 6,546,354.

TECHNICAL FIELD

The present invention relates generally to rotatable members that are able to achieve balanced conditions throughout a range of rotational speeds. The present invention also relates to methods and systems for dynamically balancing rotatable members through the continual determination of out-of-balance forces and motion to thereby take corresponding counter balancing action. The present invention additionally relates to methods and systems in which inertial masses are actively placed within a rotating body in order to cancel rotational imbalances associated with the rotating body thereon. The present invention additionally relates to methods and system for dynamic balancing utilizing concurrent control actuator actions.

BACKGROUND OF THE INVENTION

Mass unbalance in rotating machinery leads to machine vibrations that are synchronous with the rotational speed. These vibrations can lead to excessive wear and to unacceptable levels of noise.

It is a common practice to balance a rotatable body by adjusting a distribution of moveable, inertial masses attached to the body. This state of balance may remain until there is a disturbance to the system. A tire, for instance, can be balanced once by applying weights to it. This balanced condition will remain until the tire hits a very big bump or the weights are removed. However, certain types of bodies that have been balanced in this fashion will generally remain in balance only for a limited range of rotational velocities. A centrifuge for fluid extraction, however, can change the amount of balance as more fluid is extracted.

Many machines are also configured as freestanding spring mass systems in which different components thereof pass through resonance ranges during which the machine may become out of balance. Additionally, such machines may include a rotating body loosely coupled to the end of a flexible shaft rather than fixed to the shaft as in the case of a tire. Thus moments about a bearing shaft may also be created merely by the weight of the shaft. A flexible shaft rotating at speeds above half of its first critical speed can generally assume significant deformations, which add to the imbalance. This often poses problems in the operation of large turbines and turbo generators.

Machines of this kind usually operate above their first critical speed. As a consequence, machines that are initially balanced at relatively low speeds may tend to vibrate excessively as they approach full operating speed. Additionally, if one balances to an acceptable level rather than to a perfect condition (which is difficult to measure), the small remaining out-of-balance will progressively apply greater force as the speed increases. This increase in force is due to the fact that F is proportional to $r\omega^2$, (where F is the out of balance force, r is the radius of the rotating body and $\omega$ is its rotational speed).

The mass unbalance distributed along the length of a rotating body gives rise to a rotating force vector at each of the bearings that support the body. In general, the force vectors at respective bearings are not in phase. At each bearing, the rotating force vector may be opposed by a rotating reaction force, which can be transmitted to the bearing supports as noise and vibration. The purpose of active, dynamic balancing is to shift an inertial mass to the appropriate radial eccentricity and angular position for canceling the net unbalance. At the appropriate radial and angular distribution, the inertial mass can generate a rotating centrifugal force vector equal in magnitude and phase to the reaction force referred to above.

Many different types of balancing schemes are known to those skilled in the art. When rotatable objects are not in perfect balance, nonsymmetrical mass distribution creates out-of-balance forces because of the centrifugal forces that result from rotation of the object. Although rotatable objects find use in many different applications, one particular application is a rotating drum of a washing machine.

U.S. Pat. No. 5,561,993, which was issued to Elgersma et al. on Oct. 22, 1996, and is incorporated herein by reference, discloses a self-balancing rotatable apparatus. Elgersma et al. disclosed a method and system for measuring forces and motion via accelerations at various locations in a system. The forces and moments were balanced through the use of a matrix manipulation technique for determining appropriate counterbalance forces located at two axial positions of the rotatable member. The method and system described in Elgersma et al. accounted for possible accelerations of a machine, such as a washing machine, which could not otherwise be accomplished if the motion of the machine were not measured. Such a method and system was operable in association with machines not rigidly attached to immovable objects, such as concrete floors. The algorithm disclosed by Elgersma et al. permitted counterbalance forces to be calculated even when a washing machine is located on a flexible or mobile floor structure combined with carpet and padding between the washing machine and a rigid support structure.

U.S. Pat. No. 5,561,993 thus described a dynamic balance control algorithm for balancing a centrifuge for fluid extraction. To accomplish such balance control, balance control actions may place mass at the periphery of axial control planes on the centrifuge. Sensor measurements may be used to assess the immediate balance conditions. In assessing the balance conditions, measurement thresholds may be established to direct the course of balance control. Related sensor responses to balance control actions may be modeled to determine the specific future control actions. The control actions may require multiple control actuators; generally one per axial control plane, although multiple actuators at multiple control planes may emulate additional virtual control planes. The actuators may be actuated independently or concurrently. The advantage to concurrent actuation is reduced time to place the corrective mass and a smoother control trajectory to the balanced state.

With concurrent actuation, it would be ideal if concurrent corrective mass placement actions could be placed continuously and in constant proportion. An actuation system based on the placement of mass on a rotating apparatus from its stationary surroundings, however, does not permit the continuous placement of mass at any desired proportion. A limited amount of mass can be placed at a specific location only once per revolution, and the actuator action is a step action with a minimum resolution. Thus, a different and unique approach must be utilized to overcome these problems, one in which a desired control action is achieved through discretized proportions that closely represent the ideal continuous control action. Additionally, because of the discrete nature of the control actions (i.e., step actions), one must be concerned that an applied set of step actions does not exceed the threshold set for establishing balanced operations. If they do exceed this threshold, a risk may be incurred of jumping directly through the balanced condition and from one unbalanced state to another.

Based on the foregoing, it can be appreciated that a method and system, and program product implementations thereof, are required to coordinate the concurrent multi-actuator control action in order to accomplish as smooth as possible transition of mass to the control planes of the centrifuge and to ensure incremental control actions have the needed resolution to achieve balanced operation. The invention disclosed herein thus addresses these needs and the related concerns.

BRIEF SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is one aspect of the present invention to provide methods and systems in which rotatable members can achieve balanced conditions throughout a range of rotational speeds.

It is another aspect of the present invention to provide methods and systems for dynamically balancing rotatable members through the continual determination of out-of-balance forces and motion to thereby take corresponding counter balancing action.

It is yet another aspect of the present invention to provide methods and system for dynamic balancing utilizing concurrent control actuator actions.

It is still another aspect of the present invention to provide methods and systems for coordinating discrete concurrent control actuator actions in order to accomplish as smooth as possible transition to a more balanced condition and to ensure incremental control actions have the needed resolution to achieve balanced operation.

In accordance with various aspects of the present invention, methods and systems are disclosed herein for dynamic balancing of a rotating system utilizing coordinated and limited concurrent balance control actuator actions. Control actions place mass at the periphery of axial control planes of the rotating apparatus. Sensor measurements are used to assess the immediate balance conditions. In assessing the balance conditions, measurement thresholds can be established to direct the course of balance control. Related sensor responses to balance control actions are modeled to determine the specific future control actions. The control actions require multiple control actuators, at least one per axial control plane. The actuators are actuated concurrently in order to reduce time to place the corrective mass and provide a smooth transition to the balanced state. With actuator configurations that do not provide for corrective mass to be placed continuously or in constant proportion, the desired control action is achieved through discretized proportions that closely represent the continuous and proportionate control action. The discrete control actions (i.e., step actions) are limited so as to not exceed the thresholds set for establishing balanced operations.

BRIEF DESCRIPTION OF THE DRAWINGS

The accompanying figures, in which like reference numerals refer to identical or functionally-similar elements throughout the separate views and which are incorporated in and form part of the specification, further illustrate the present invention and, together with the detailed description of the invention, serve to explain the principles of the present invention.

FIG. 8 illustrates a table of a simultaneous dual-actuator algorithm implementation, in accordance with preferred embodiments of the present invention.

DETAILED DESCRIPTION OF THE INVENTION

The particular values and configurations discussed in these non-limiting examples can be varied and are cited merely to illustrate embodiments of the present invention and are not intended to limit the scope of the invention.

The present invention is generally an improvement to the invention disclosed in U.S. Pat. No. 5,561,993. The basic configuration and concepts explained in U.S. Pat. No. 5,561,993 are disclosed herein but in no way limit the scope of the invention described and claimed herein. Features revealed in U.S. Pat. No. 5,561,993 are presented herein for illustrative purposes only, in order to explain the foundation upon which the present invention has been derived. Those skilled in the art can appreciate that such features, including figure, text, descriptions, equations and tables thereof do not limit the scope of the present invention.

Figure 1:
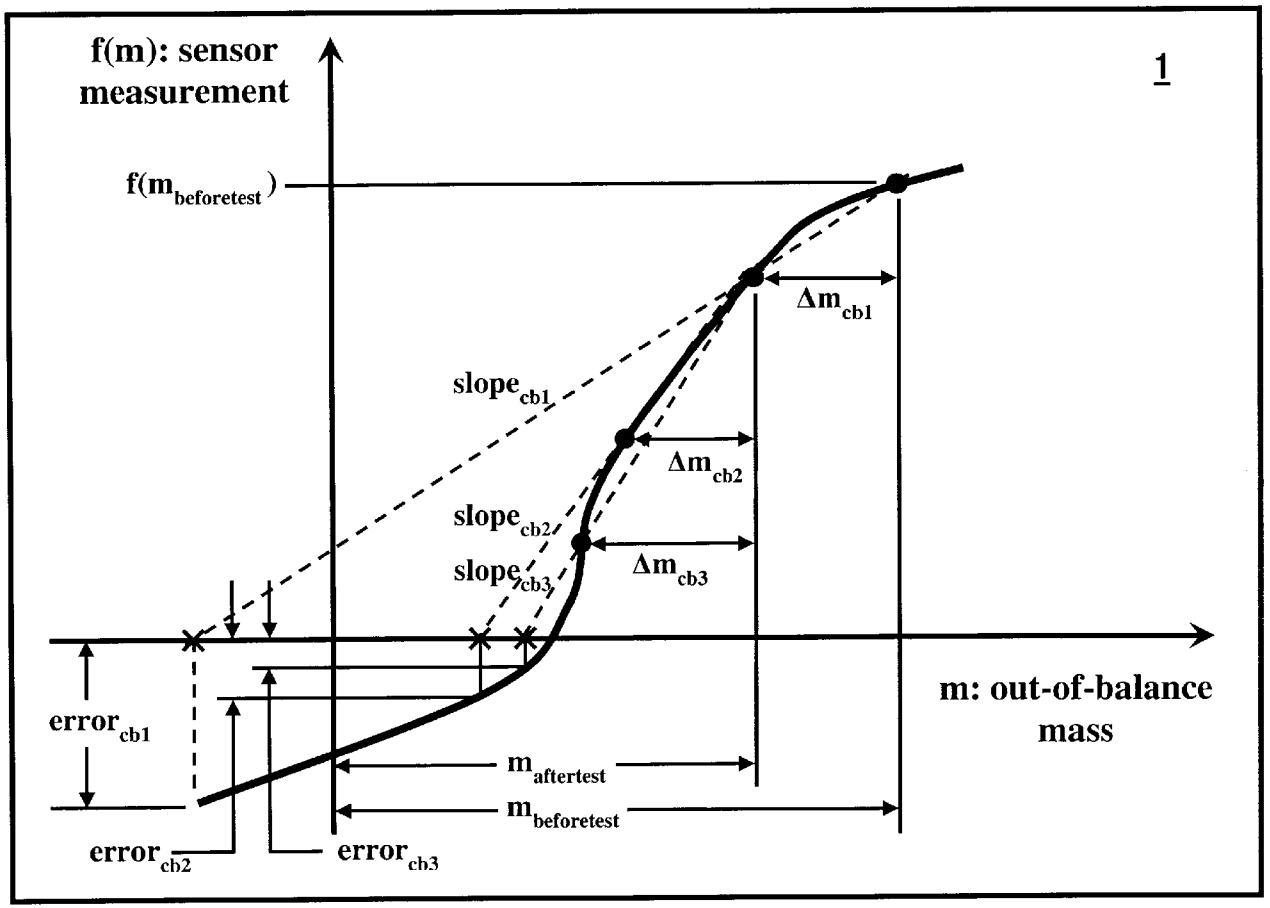
FIG. 1 depicts a plot of a non-linear system, in accordance with preferred embodiments of the,present invention.

FIG. 1 depicts a plot of a non-linear system 1, in accordance with preferred embodiments of the present invention. Given a very simple (e.g., one-dimensional) non-linear system, such as the non-linear system in FIG. 1, the system can be balanced when the sensor measurement, f(m), is driven to zero. The objective of such a system is to find a value for a counterbalance Δm, such that the sensor measurement f(m) is driven to zero, i.e., f(m)=0. Utilizing a Taylor's series expansion in the vicinity of the anticipated operating range and neglecting second order and higher terms, results in a linear model of the form y=b+mx. The linear model can be written to reflect the example illustrated in FIG. 1, where several possible line estimates are shown; equation 1 expresses this relationship.

$$f(m_{next}) \approx f(m_{aftertest}) + \left(\frac{\partial f(m)}{\partial m}\right) \cdot (m_{next} - m_{aftertest}) \tag{1}$$

Those skilled in the art can appreciate that $f(m_{next})$ represents the desired sensor measurement. In addition, $f(m_{aftertest})$ can represent the sensor measurement after a test action or a prior balance-control action. The variable m generally represents the out-of-balance in the system. For example, the variable $m_{aftertest}$ generally represents the out-of-balance after a test action ($\Delta m_{test}$), and the change in m, (i.e., $\Delta m = m_{next} - m_{aftertest}$), is the counterbalance required to achieve a desired sensor measurement, ($f(m_{next})=0$). The control action involves moving in the direction of the estimated counterbalance and updating the system model and the required counterbalance estimate as control progresses. Those skilled in the art can appreciate that this control implementation of equation 1 represents the well-known Newton Raphson iteration method.

Since the objective is to find $f(m_{next})=0$, the general form of the equation reduces to:

$$m_{next} = m_{aftertest} - \left[\frac{\partial f(m)}{\partial m}\right]^{-1} \cdot f(m_{aftertest}) \tag{2}$$

where $m_{next}$ is the solution or system out of balance needed to make $f(m_{next})=0$ or to drive the sensor measurement to zero. Thus, the estimated mass change $\Delta m_{cb}$ generally required for counterbalance action is illustrated in equation 3.

$$\Delta m_{cb} = m_{next} - m_{aftertest} = -f(m_{aftertest}) \Big/ \left(\frac{\partial f}{dm}(m_{aftertest})\right) \tag{3}$$

The partial derivative, or slope of the sensor function, can be found by perturbing the system. This may be generally illustrated in equation 4, which represents the change in sensor measurements due to a test action ($\Delta m_{test} = m_{aftertest} - m_{beforetest}$).

$$\frac{\partial f}{dm}(m_{aftertest}) = \frac{f(m_{aftertest}) - f(m_{beforetest})}{m_{aftertest} - m_{beforetest}} \tag{4}$$

Combining equations 3 and 4 may result in the generalized form shown in equation 5, which equation is generally expressed in an expanded notion of multiple inputs and outputs.

$$[f(m_{aftertest})] = -\left[\frac{\partial f(m)}{\partial m}\right] \cdot [\Delta m_{solution}] \tag{5}$$

Regarding the linear models and associated slope calculation in FIG. 1, it can be appreciated that a change in the mass may result in a change in the system, and the system itself may be nonlinear; thus, the linear model used to determine the next counterbalance may have significant error. Therefore, when applying the Newton Raphson iteration to a process, certain requirements should be followed. First, the initial approximation should be sufficiently accurate to result in subsequent operation near the desired solution and the measurement f(m) being smooth, nearly linear and single-valued in the vicinity of the anticipated operation. Additionally, because higher derivatives are neglected in this type of approximation, the higher derivatives should be small, so as to avoid convergence problems.

Figure 2:
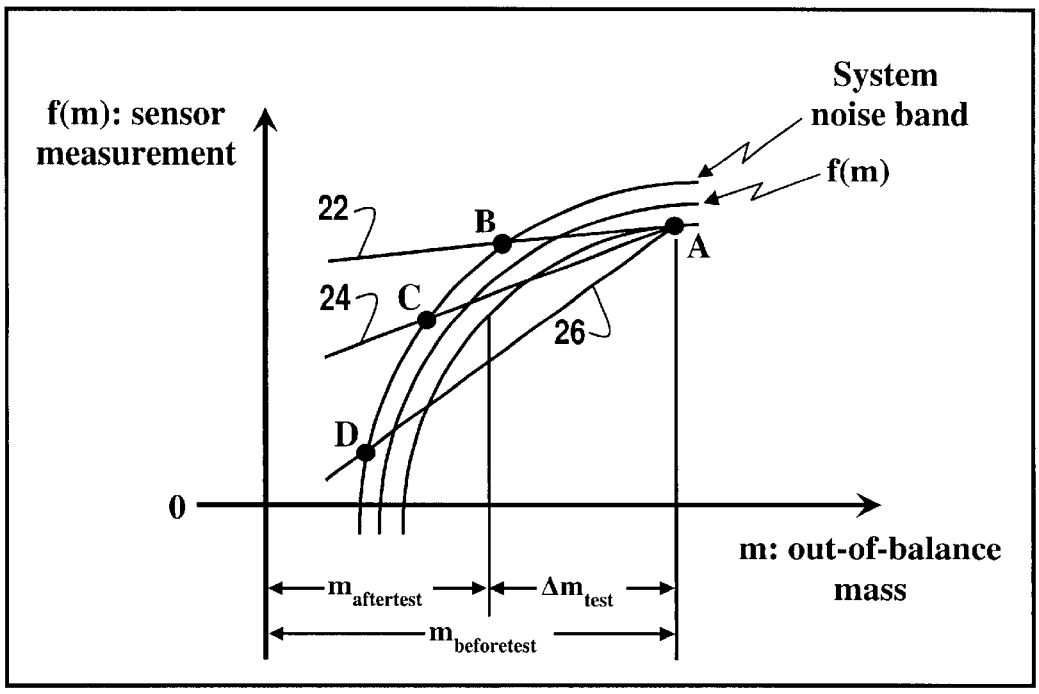
FIG. 2 illustrates a graphical representation of a nonlinear system and the effect of system noise with which the present invention must be concerned.

Lastly, in applications of the Newton Raphson iteration, only one solution of mass $\Delta m_{cb}$ should exist for the sensor measurement being equal to zero. This means there is only one root. Even after following the above requirements, system noise may be a concern. In the hypothetical illustration of FIG. 2, a larger initial test action, which changes the system to point C, is preferable to the one that changes it to point B. This is evidenced by comparing the slopes of lines 22, 24 and 26, which result from the various test mass perturbations depicted in FIG. 2. The difference between the before and after test measurement should be large enough to obtain a good approximation of the slope of the function and ensure that the resulting change in the measurement dominates the changes due to system noise.

Figure 3:
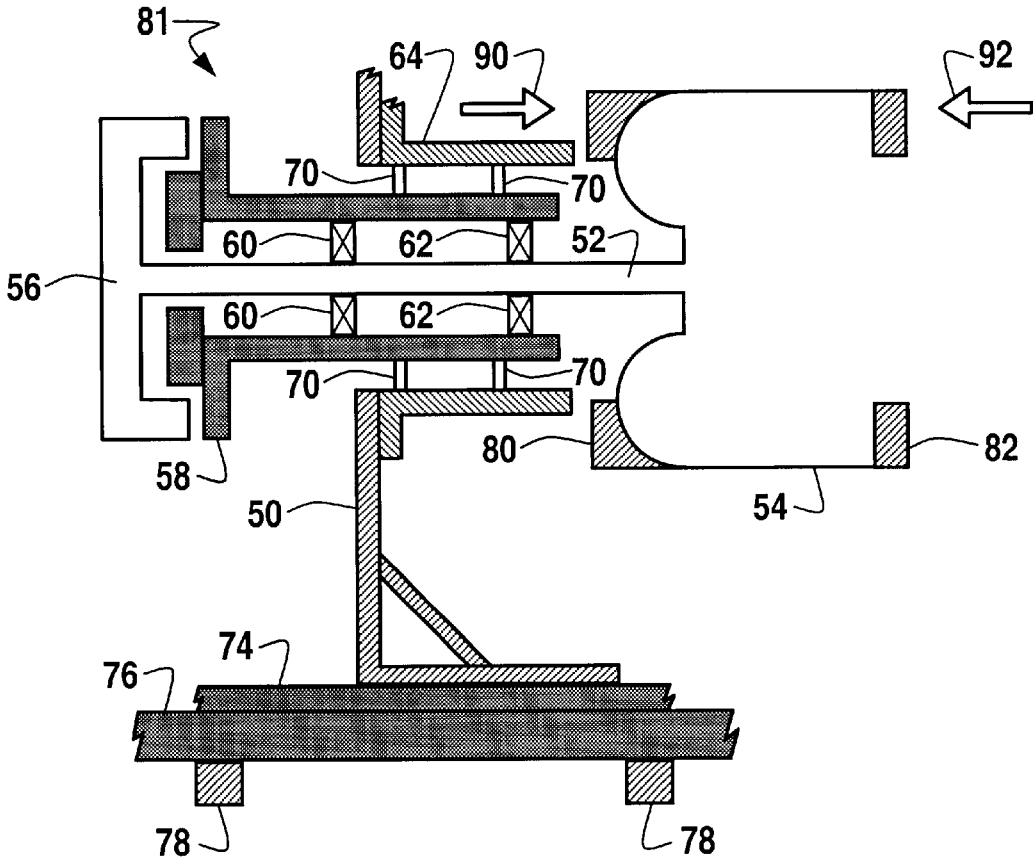
FIG. 3 depicts a schematic representation of a washing machine, which may be adapted for use in association with the present invention.

FIG. 3 depicts a schematic representation of a washing machine 81, which may be adapted for use in association with the present invention. Those skilled in the art can appreciate that the present invention may be implemented within a rotating device or rotating system, such as, for example, washing machine 81. Those skilled in the art can further appreciate, however, that other types of rotatable systems or rotating devices may be utilized in accordance with the present invention. Note that as utilized herein, the terms "rotating system," "rotating device," "rotating apparatus," "rotatable apparatus," "rotatable system," or "rotatable device" may be utilized interchangeably. The methods and systems of the present invention may be implemented to balance rotating systems, rotating devices or rotating members thereof. Examples of such rotating devices or rotating systems include washing appliances, such as washing machines, dishwashers, circuit board cleaners, and so forth.

In the example of FIG. 3 the basic mechanism of dynamic balancing involves counter balancing the out-of-balance load by injecting water into a plurality of cups placed at front and back axial planes, identified by reference numbers 82 and 80 in FIG. 3, of the rotatable drum. Although the terms "test mass" or "mass" may be used to describe the preferred embodiment fluid mass, those skilled in the art can appreciate that such a mass may be comprised of many different materials, and the invention is not limited to fluid-based injection for placing mass.

FIG. 3 thus schematically illustrates a washing machine 81 comprising a frame 50, a shaft 52 and a rotatable drum 54. Shaft 52 may be attached to rotatable drum 54. These two components can be attached to a rotor or pulley 56 of a motor drive. Frame 50 can provide support for a bearing housing 58 in which bearings, 60 and 62, are generally supported. A housing mount 64 can support bearing housing 58. A plurality of sensors identified by the reference numeral 70 is illustrated at location between the housing mount and the bearing housing in FIG. 3. These sensors are described in greater detail below. Beneath frame 50 are generally shown a carpet and pad 74, a plywood support member 76 and a plurality of joists 78. The representation shown in FIG. 3 illustrates a typical application of a horizontal washing machine in a residential housing environment. Those skilled in the art can appreciate that FIG. 3 is presented for illustrative purposes only and that a variety of washing machine configurations and other rotating devices not illustrated herein may be utilized to implement varying embodiments of the present invention.

With continued reference to FIG. 3, the rotatable drum 54 may be shown having a plurality of schematically illustrated back cups 80 and front cups 82. Both the front and back cups may be disposed at axial ends of the rotatable drum 54 and, although not shown in FIG. 3, both the front and back cups can comprise a plurality of cups dispersed around the periphery of the drum. A quantity of water can be injected into the cups from a stationary control valve supplied with water, such as those identified by reference numerals 90 and 92.

Some balancing systems assume the machine may be attached rigidly to an immovable object or footing, such as a concrete floor. In many practical residential housing applications, however, the machine is not rigidly attached to an immovable object and, instead, may be associated with a plurality of flexible members. For example, FIG. 4, depicts a schematic representation of a type of arrangement usually encountered in washing machine applications, showing a spring and mass illustration of the manner in which a nonrigid washing machine can behave if mounted on nonrigid structures.

The behavior of frame 50 in relation to footing 79 can be described as a spring representing frame 50 and floor 76 and having a spring constant K1. The relationship between a tub 53 (not shown in FIG. 3) surrounding the rotatable drum 54 and frame 50 can be described by a spring constant K2. A spring constant K3 represents the relationship between bearing housing 58 and housing mount 64, and frame 50 in FIG. 3. Lastly, FIG. 4 illustrates a spring constant K4, which represents the bending of shaft 52, along with rotatable members 54 and 56.

Figure 4:
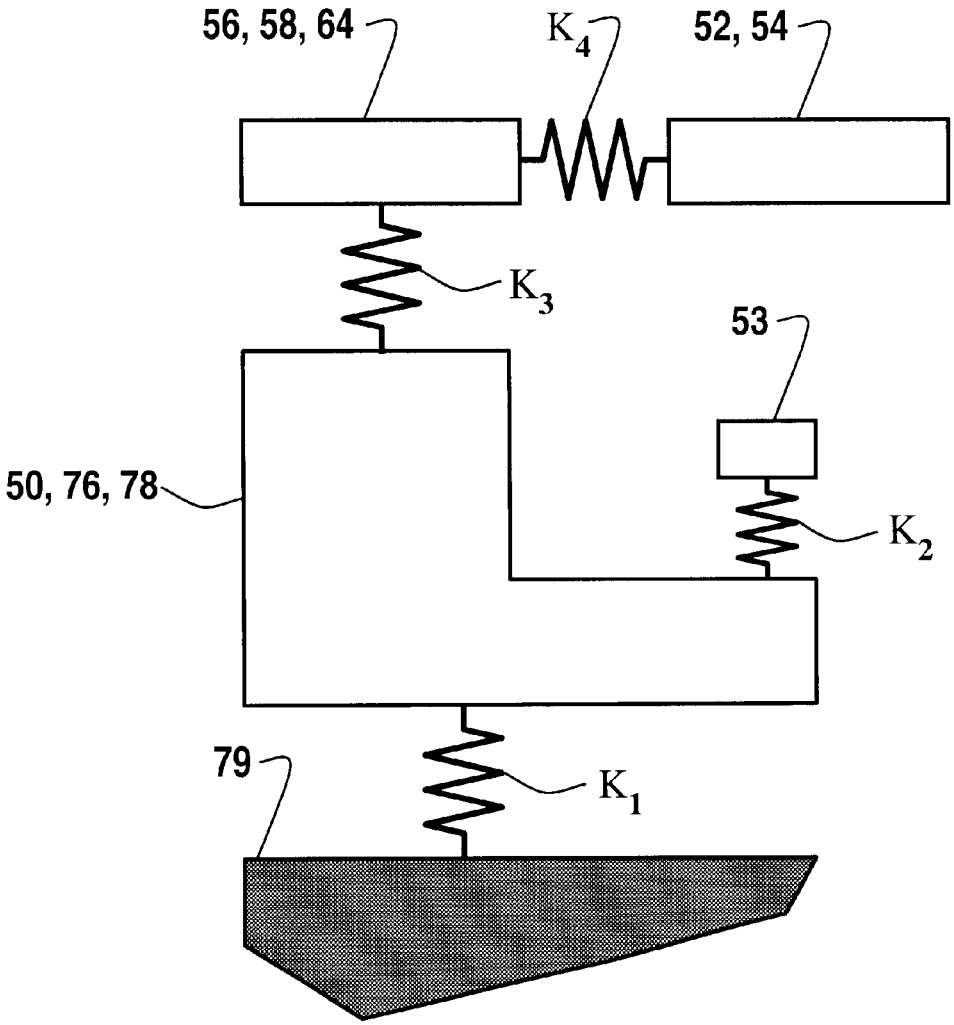
FIG. 4 is a spring and mass illustration depicting the manner in which a nonrigid washing machine can behave if mounted on nonrigid structures.

Although only represented by boxes in FIG. 4, the schematic illustration depicts a multitude of mass-spring subsystems that define the relationships among major components of the overall system. One purpose for illustrating FIG. 4 is to demonstrate that the relationships among these components are not rigid and, as a result, can permit motion, resulting in accelerations, to occur in response to forces exerted on the various components. Therefore, if the system is not rigid and only forces are measured by the sensors 70 shown in FIG. 3, accurate counterbalance determinations would be extremely difficult, if not impossible, to make.

Figure 5:
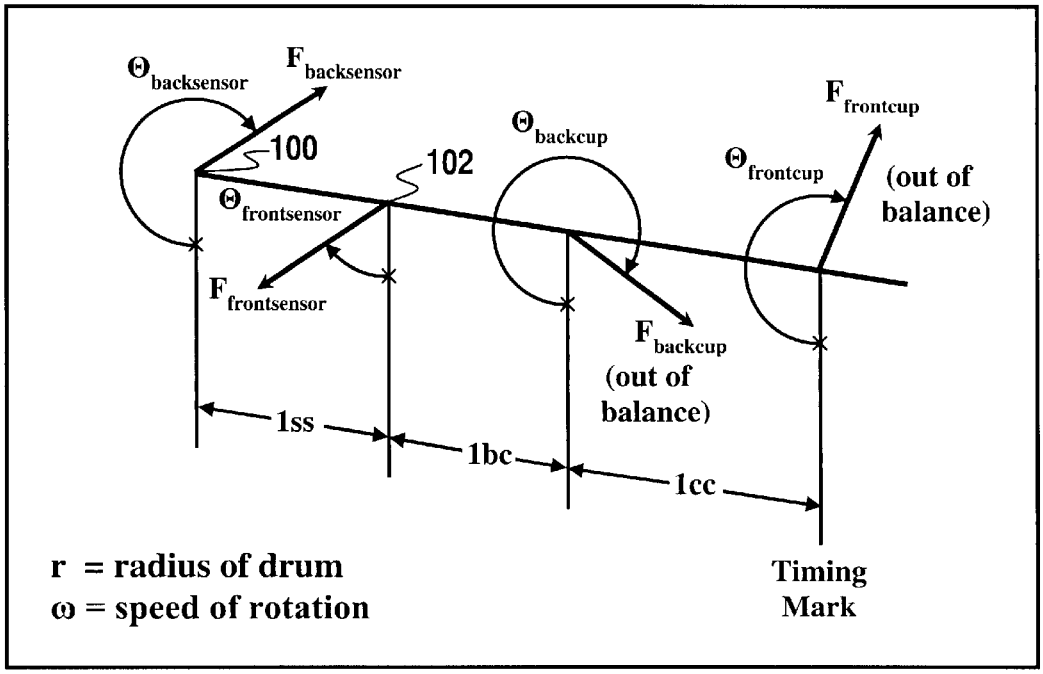
FIG. 5 depicts a three-dimensional schematic representation of the forces and critical lengths along an axis of rotation, which has been extended along a length of the shaft and through a length of the drum.

FIG. 5 illustrates a three-dimensional schematic representation of the forces and critical lengths along the axis of rotation, which has been extended along the length of the shaft and through the length of the drum. Force sensors may be mounted to measure the force transmitted between housing mount 64 and bearing housing 58, as illustrated in FIG. 3. The basic concept of dynamic balancing stipulates that vector forces at the front and back cups may represent an out-of-balance condition. Referring to FIG. 5, the system may be provided with a mechanism for sensing a first force $F_{backsensor}$ at a first location 100 of the axis of rotation and a second mechanism for measuring a second force $F_{frontsensor}$ at a second location 102 of the axis of rotation. It should be understood that both the first and second forces shown in FIG. 5 are likely to be determined from a plurality of force sensors arranged so that the resultant force vectors along multiple axes of the system, can be determined at each of the first and second locations, 100 and 102, of the axis of rotation.

If a washing machine or similar apparatus with a rotating member is rigidly attached to an unmovable object, such as a concrete floor, in such a way that movement of the machine is prevented, a mere force and moment analysis based on forces and moment arms shown in FIG. 5 would be appropriate and, thus, yield sufficient information to allow counterbalance forces to be implemented in a manner that would achieve a balance of a rotating drum 54. As discussed above in association with FIGS. 3 and 4, however, it is not practical to expect a machine of this type to be installed and operate without motion being experienced by the various portions of the machine. Therefore, it may be beneficial to measure motion relative to a footing or inertial space (e.g., acceleration) and account for it in the analysis of forces.

Figure 6:
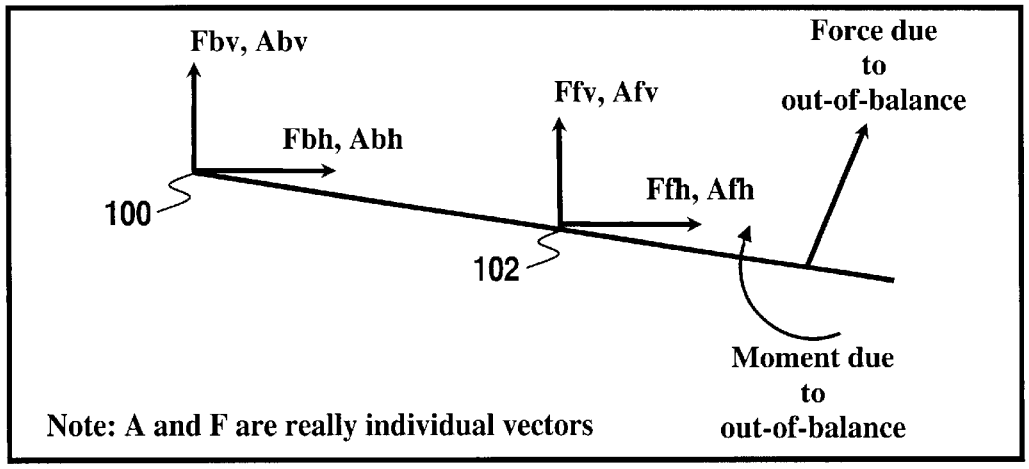
FIGS. 6 and 7 depict a graphical representation of a shaft with measured forces and accelerations.
Figure 7:
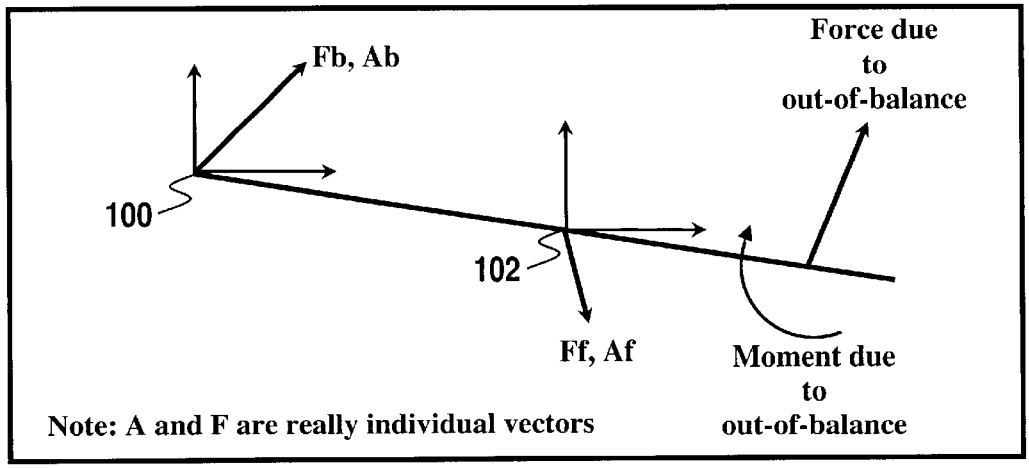

FIGS. 6 and 7 show the measurement of forces and accelerations in three-dimensional space at various locations along the shaft 52. Viewing FIGS. 6 and 7 together, it can be seen the forces and accelerations can be measured at two coincident locations on the shaft 52. It can be appreciated, however, that this coincidence of the first force and the first acceleration or the second force and the second acceleration are not requirements of the present invention. At each of the first and second locations, 100 and 102, the effects of rotating out-of-balance forces are determined along the horizontal (h) and vertical (v) coordinates. It can be appreciated by those skilled in the art that the coordinates illustrated in FIGS. 6 and 7 represent the fact that the concepts in U.S. Pat. No. 5,561,993 and the present invention, operate with information describing the forces in terms of a magnitude, a fixed direction and an associated rotating drum angle. Similarly, the motion (e.g., accelerations) may also be expressed as a magnitude along a fixed direction with an associated rotating drum angle.

TABLE I

| VARIABLE | MEANING |
|---|---|
| Inputs | |
| $\Delta m_{front_cb}$ | test counterbalance mass placed in the front plane (vector) |
| $\Delta m_{back_cb}$ | test counterbalance mass placed in the back plane (vector) |
| ωback | speed of rotation in (rad/sec) at which the back plane test counterbalance occurred |
| ωfront | speed of rotation in (rad/sec) at which the front plane test counterbalance occurred |
| R | radius of counterbalance placement (inches) |
| ω | current speed of rotation |
| Outputs | |
| $f_{back}$ | back force sensor (lbf) (vector) |
| $f_{front}$ | front force sensor (lbf) (vector) |
| $a_{back}$ | back accelerometer sensor (in/sec$^2$) (vector) |
| $a_{front}$ | front accelerometer sensor (in/sec$^2$) (vector) |
| Actions | |
| $m_{backplane_cb}$ | estimated backplane counterbalance to drive sensor readings to zero (vector) |

TABLE I-continued

| VARIABLE | MEANING |
|---|---|
| $m_{frontplane_cb}$ | estimated frontplane counterbalance to drive sensor readings to zero (vector) |

For the following discussion, Table I illustrates the inputs and outputs utilized in the multi-input/multi-output condition relating to the invention described in U.S. Pat. No. 5,561,993. In order to find the appropriate solutions for the counterbalance forces described above, measured forces and accelerations should be considered in the balancing of system forces and moments. As described above, the counterbalance masses, forces and accelerations represent magnitudes and angles. Therefore, all variables shown in Table I, except r and ω generally comprise both a magnitude and an angle in polar coordinates which can be converted to complex coordinates. The relationship described in equation 5 above can be rewritten for the multi-input/multi-output case to result in four coupled simultaneous equations, incorporating the effects of perturbations in both front and back planes that could have occurred at rotational speeds slightly different from the current speed. These four relationships are shown below and are identified as equation 6.

$$a_{back\ 4} = -\left(\frac{a_{back\ 1} - a_{back\ 0}}{r \cdot \omega_{back}^2 \cdot \Delta m_{\text{back_cb}}}\right) \cdot r \cdot \omega^2 \cdot m_{\text{backplane_cb}} - \left(\frac{a_{back\ 3} - a_{back\ 2}}{r \cdot \omega_{front}^2 \cdot \Delta m_{\text{front_cb}}}\right) \cdot r \cdot \omega^2 \cdot m_{\text{frontplane_cb}} \tag{6}$$

$$a_{front\ 4} = -\left(\frac{a_{front\ 1} - a_{front\ 0}}{r \cdot \omega_{back}^2 \cdot \Delta m_{\text{back_cb}}}\right) \cdot r \cdot \omega^2 \cdot m_{\text{backplane_cb}} - \left(\frac{a_{front\ 3} - a_{front\ 2}}{r \cdot \omega_{front}^2 \cdot \Delta m_{\text{front_cb}}}\right) \cdot r \cdot \omega^2 \cdot m_{\text{frontplane_cb}}$$

$$f_{back\ 4} = -\left(\frac{f_{back\ 1} - f_{back\ 0}}{r \cdot \omega_{back}^2 \cdot \Delta m_{\text{back_cb}}}\right) \cdot r \cdot \omega^2 \cdot m_{\text{backplane_cb}} - \left(\frac{f_{back\ 3} - f_{back\ 2}}{r \cdot \omega_{front}^2 \cdot \Delta m_{\text{front_cb}}}\right) \cdot r \cdot \omega^2 \cdot m_{\text{frontplane_cb}}$$

$$f_{front\ 4} = -\left(\frac{f_{front\ 1} - f_{front\ 0}}{r \cdot \omega_{back}^2 \cdot \Delta m_{\text{back_cb}}}\right) \cdot r \cdot \omega^2 \cdot m_{\text{backplane_cb}} - \left(\frac{f_{front\ 3} - f_{front\ 2}}{r \cdot \omega_{front}^2 \cdot \Delta m_{\text{front_cb}}}\right) \cdot r \cdot \omega^2 \cdot m_{\text{frontplane_cb}}$$

The four mathematical relationships illustrated in equation 6 above can be grouped together as a single equation because they are treated as a matrix in the following discussion. The meanings of the subscripts in equation 6 above are identified in Table II.

TABLE I

| SUBSCRIPT | MEANING |
|---|---|
| 0 | Measurement prior to backplane counter-balance test mass $\Delta m_{back_cb}$ |

TABLE I-continued

| SUBSCRIPT | MEANING |
|---|---|
| 1 | Measurement after backplane counter-balance test mass $\Delta m_{back_cb}$ |
| 2 | Measurement prior to frontplane counter-balance test mass $\Delta m_{front_cb}$ |
| 3 | Measurement after frontplane counter-balance test mass $\Delta m_{front_cb}$ |
| 4 | Current sensor measurement |

The relationships shown above in equation 6 can be applied to equation 5 in matrix form as:

$$\begin{bmatrix} a_{back\ 4} \\ a_{front\ 4} \\ f_{back\ 4} \\ f_{front\ 4} \end{bmatrix} = -\begin{bmatrix} \frac{a_{back\ 1} - a_{back\ 0}}{r \cdot \omega_{back}^2 \Delta m_{\text{back_cb}}} & \frac{a_{back\ 3} - a_{back\ 2}}{r \cdot \omega_{front}^2 \Delta m_{\text{front_cb}}} \\ \frac{a_{front\ 1} - a_{front\ 0}}{r \cdot \omega_{back}^2 \Delta m_{\text{back_cb}}} & \frac{a_{front\ 3} - a_{front\ 2}}{r \cdot \omega_{front}^2 \Delta m_{\text{front_cb}}} \\ \frac{f_{back\ 1} - f_{back\ 0}}{r \cdot \omega_{back}^2 \Delta m_{\text{back_cb}}} & \frac{f_{back\ 3} - f_{back\ 2}}{r \cdot \omega_{front}^2 \Delta m_{\text{front_cb}}} \\ \frac{f_{front\ 1} - f_{front\ 0}}{r \cdot \omega_{back}^2 \Delta m_{\text{back_cb}}} & \frac{f_{front\ 3} - f_{front\ 2}}{r \cdot \omega_{front}^2 \Delta m_{\text{front_cb}}} \end{bmatrix} \cdot \begin{bmatrix} m_{\text{backplane_cb}} \\ m_{\text{frontplane_cb}} \end{bmatrix} \cdot r \cdot \omega^2 \tag{7}$$

where we describe this matrix equation as being in the form b=Ax and $$A = -\frac{\partial f(m)}{\partial m} = -\begin{bmatrix} \frac{a_{back\ 1} - a_{back\ 0}}{r \cdot \omega_{back}^2 \cdot \Delta m_{\text{back_cb}}} & \frac{a_{back\ 3} - a_{back\ 2}}{r \cdot \omega_{front}^2 \cdot \Delta m_{\text{front_cb}}} \\ \frac{a_{front\ 1} - a_{front\ 0}}{r \cdot \omega_{back}^2 \cdot \Delta m_{\text{back_cb}}} & \frac{a_{front\ 3} - a_{front\ 2}}{r \cdot \omega_{front}^2 \cdot \Delta m_{\text{front_cb}}} \\ \frac{f_{back\ 1} - f_{back\ 0}}{r \cdot \omega_{back}^2 \cdot \Delta m_{\text{back_cb}}} & \frac{f_{back\ 3} - f_{back\ 2}}{r \cdot \omega_{front}^2 \cdot \Delta m_{\text{front_cb}}} \\ \frac{f_{front\ 1} - f_{front\ 0}}{r \cdot \omega_{back}^2 \cdot \Delta m_{\text{back_cb}}} & \frac{f_{front\ 3} - f_{front\ 2}}{r \cdot \omega_{front}^2 \cdot \Delta m_{\text{front_cb}}} \end{bmatrix} \tag{8}$$

Equations 6, 7 and 8 depict the mathematical model generally described in U.S. Pat. No. 5,561,993. This mathematical model is formulated, such that the dynamics of the system are divided into two columns based on whether-mass is placed in the front plane (i.e., column 2) or the back plane (i.e., column 1) of the spinner. The present invention disclosed herein may be used with this control model or like extensions, the more general solution of which allows for the placement of mass in both the front and the back plane simultaneously to formulate the control model and apply control actions. This more general control model solution is briefly discussed and used herein for describing the present invention.

For the more general control model solution, the model developed in equations 5, 6, and 7, take on the general form shown in equation 9.

$$f(i+2) = -\left[\frac{f(i+1) - f(i)}{\|m(i+1) - m(i)\|} \quad \frac{f(i+2) - f(i+1)}{\|m(i+2) - m(i+1)\|}\right]\left[\frac{m(i+1) - m(i)}{\|m(i+1) - m(i)\|} \quad \frac{m(i+2) - m(i+1)}{\|m(i+2) - m(i+1)\|}\right]^{-1}\begin{bmatrix} \Delta m_{back} \\ \Delta m_{front} \end{bmatrix} \tag{9}$$

In equation 9 above, f(i) represents the $i^{th}$ sensor reading; f(i+2) is equivalent to $f(m_{aftertest})$ illustrated in equation 5. Also, m(i) may be a complex vector representing the force at the front and back planes of the rotating apparatus resulting from the $i^{th}$ test action. The equation Δm(i+1)=m(i+1)−m(i) may represent a complex vector of counter balance force or test actions applied to the spinner; each test action formed by injecting simultaneously in the front and the back plane of the spinner. The A matrix (df(m)/dm) obtained from equation 5 is now represented by the relation shown in equation 10.

$$A = -\frac{\partial f}{\partial m(i)} = -\left[\frac{f(i+1)-f(i)}{\|m(i+1)-m(i)\|} \quad \frac{f(i+2)-f(i+1)}{\|m(i+2)-m(i+1)\|}\right]\left[\frac{m(i+1)-m(i)}{\|m(i+1)-m(i)\|} \quad \frac{m(i+2)-m(i+1)}{\|m(i+2)-m(i+1)\|}\right]^{-1} \tag{10}$$

Equation 11 below shows the A matrix for the more general control model solution, where 2 control actuators, or control planes, and 4 sensor readings are available, as in the case of equations 6 through 8.

$$A = -\begin{bmatrix} \frac{a_{back\ 1}-a_{back\ 0}}{\|\Delta m(1)_{cb}\|} & \frac{a_{back\ 2}-a_{back\ 1}}{\|\Delta m(2)_{cb}\|} \\ \frac{a_{front\ 1}-a_{front\ 0}}{\|\Delta m(1)_{cb}\|} & \frac{a_{front\ 2}-a_{front\ 1}}{\|\Delta m(2)_{cb}\|} \\ \frac{f_{back\ 1}-f_{back\ 0}}{\|\Delta m(1)_{cb}\|} & \frac{f_{back\ 2}-f_{back\ 1}}{\|\Delta m(2)_{cb}\|} \\ \frac{f_{front\ 1}-f_{front\ 0}}{\|\Delta m(1)_{cb}\|} & \frac{f_{front\ 2}-f_{front\ 1}}{\|\Delta m(2)_{cb}\|} \end{bmatrix} \cdot \begin{bmatrix} \frac{\Delta m(1)_{\text{back_cb}}}{\|\Delta m(1)_{cb}\|} & \frac{\Delta m(1)_{\text{back_cb}}}{\|\Delta m(2)_{cb}\|} \\ \frac{\Delta m(1)_{\text{front_cb}}}{\|\Delta m(1)_{cb}\|} & \frac{\Delta m(1)_{\text{front_cb}}}{\|\Delta m(2)_{cb}\|} \end{bmatrix}^{-1} \tag{11}$$

The equation relationships shown in equation 9 can be rearranged to solve for the counterbalance forces, $\Delta m_{back}$ and $\Delta m_{front}$, required to bring the system into balance. Utilizing the A matrix from equation 11 for the case of four sensors, a relationship can be expressed through equation 12 as follows:

$$\begin{bmatrix} \Delta m_{back} \\ \Delta m_{front} \end{bmatrix} = A^{+} \cdot \begin{bmatrix} a_{back} \\ a_{front} \\ f_{back} \\ f_{front} \end{bmatrix} \tag{12}$$

In a situation such as that described by equation 12 above, four sensor values (i.e., two accelerations and two forces) are generally known from measurements. Two counterbalance forces are unknown. This results in a situation where there are more equations than unknowns as each sensor provides an equation. Conversely, there are only two unknown counterbalance forces for the front and back planes of the drum. This condition describes an over-determined system and a technique generally required to solve for more equations than unknowns in an optimal manner.

A technique for solving equations of this type in a balancing scheme should find a solution that minimizes all of the sensor readings and also minimizes the amount of counterbalance media required to balance the rotating system or rotating device. In other words, the force sensors and the accelerometers should all be driven as close to zero as possible by the selected counterbalances and the total amount of counterbalance media (i.e., fluid or mass) applied be minimized.

Those skilled in the art can appreciate that a mathematical technique which may solve this problem involves computation of the pseudo-inverse of the A matrix ($A^{+}$) utilizing a singular value decomposition (SVD) technique. This solution method finds the optimal solution to the inconsistent system represented simply by equation 9. The SVD is one of several techniques that can support the pseudo-inverse calculation for control. It can provide optimal control for both inputs and outputs of the modeled system. Other variations of the components that make up the SVD may be used alone, but would not provide both input and output optimization. This procedure is fully described in U.S. Pat. No. 5,561,993, which is incorporated by reference herein. The SVD technique is well known to those skilled in the art and is described in significant detail in various reference linear algebra textbooks.

After generating the solution to equation 12, it may be necessary to formulate a practical approach to applying the counterbalance mass to the rotating member so as to move as directly as possible toward a more balanced state. An approach to applying counterbalance control actions as part of a balance control scheme is fully described in U.S. Pat. No. 5,561,993, which is incorporated herein, along with extensions for simultaneous control actuator activation, for illustrative and background purposes only. To accomplish balance control, balance control actions may place mass at the periphery of axial control planes on the centrifuge. Sensor measurements may be used to assess the immediate balance conditions through the use of measurement thresholds, established to direct the course of balance control. Measurements of the forces and motions at various locations within the rotatable apparatus are made before and after each control action and may be used to update the control model described by equations 9 through 12. That updated model along with further sensor measurements may be utilized to determine a prediction of the next required counterbalance control action. This process continues until balance condition is achieved (i.e., all sensor values below balance threshold) at full operating speed.

The control actions may require multiple control actuators, generally one per axial control plane, although multiple actuators at multiple control planes may emulate additional virtual control planes. The actuators may be actuated independently or concurrently. The advantage to concurrent actuation is reduced time to place the corrective mass-and a smoother control trajectory to the balanced state.

With concurrent actuation, it would be ideal if these optimal counterbalances, determined by solving the system model in the manner described herein, were completely applied in a continuous fashion and at constant proportion across the multiple actuators, thereby smoothly driving all of the sensors to zero and achieving perfect balance of the rotating member. An actuation system based on placing mass to the rotating apparatus from its stationary surroundings in step-like actions, however, does not allow continuous placement of mass at any constant proportion. For each actuator, a limited amount of mass can be placed at a specific location on the rotating member only once per revolution, and the actuator action is a step action with a minimum resolution. Additionally, because of the discrete nature of the control actions (i.e., step actions), one must be concerned that an applied set of step actions does not exceed the threshold set for establishing balanced operations. If they do exceed this threshold, a risk may be incurred of jumping directly through the balanced condition and from one unbalanced state to another.

Thus, a different and unique approach must be utilized to overcome these problems, one in which a desired control action is achieved through discretized proportions that closely represent the ideal continuous control action. The present invention provides methods and system for coordinating discrete concurrent control actuator actions in order to accomplish as smooth as possible transition to a more balanced condition, and to ensure incremental control actions have the needed resolution to achieve balanced operation.

In the illustrative configuration disclosed herein, counterbalance control actions may be mathematically resolved into mass placement actions for each control plane. The mass placement actions can then be applied simultaneously to a centrifuge (i.e., spinner) that may have a front and back radial plane normal to the axis of rotation and bound by the circumference of the cylinder. The circumference of each plane may be lined with cups to retain mass that is strategically placed across a predetermined range of rotation angles to dynamically create balanced conditions during spinning operations. These cup-lined planes may comprise control planes. For each control plane, the mass is placed via an injector valve mounted on the stationary (i.e., not rotating) part of the system. As the appropriate spinner cups pass the injector valve, mass can be released into the cups. In order to apply the total desired control action, the mass is often injected over a number of revolutions of the rotating device or rotating system.

The desired control action is converted to mass to be placed for the front and back control planes. The mass-placement actuators can each be characterized and appropriate factors applied to determine the amount of mass contributing to the desired control action per actuation. The front and back mass may then be converted to front and back control actuator actions: mass placed per actuation, number of actuations, and angular span of actuation. Thus, a control action may comprise a number of cycles or steps of the control actuator placing incremental amounts of mass over an angular span of the control plane per rotation, located about a desired point-effect location. A system constant may be established that provides a limit for force applied to the control plane across a set of mass placement steps. This force limit can ensure that an applied subset of step actions does not exceed the sensor measurement thresholds establishing balanced operation. This force limit can be associated with a specific mass value, and thereafter converted to a number of control actuator actions, both adjusted for rotational speed. The parameters in equation 13 may be utilized.

Force limit=2 lbf=$mr\omega^2$ $r$=cylinder radius $\omega=(\text{RPM}\times 2^{\pi})/60$=rotation speed in radians per second $m=(2\text{ lbf})/(r\omega^2)$=point-mass limit so balance threshold not exceeded $mg=(2\times g)/(r\omega^2)$=point-mass limit weight based on gravity g=386.4 in/sec$^2$ (13)

Both front and back control actuators may place the same or different increments of mass per mass-placement cycle or step, and each can be turned on a different number of cycles or steps in order to achieve the total desired control action. These front and back control actuator actions may occur simultaneously as provided by the enhanced balance control model discussed herein and in accordance with the methods and systems of the present invention. Control actuator actions can be applied in subsets that may not exceed the force limit checks, which are based on balance thresholds. The variables in equation 14 may be utilized.

*FlnjNo*=Number of front control actuator steps for desired control action,

*BlnjNo*=Number of back control actuator steps for desired control action,

*FThrNo*=Number of front control actuator steps in the force-limited set,

*BThrNo*=Number of back control actuator steps in the force-limited set, $ThrNo=FThrNo_0+BThrNo_0$ =Total number of control actuator steps in the desired force-limited set. (14)

It is preferable to step through the control actuator actions FlnjNo and BlnjNo in incremental sets that do not exceed ThrNo, while at the same time closely maintaining the proportion FlnjNo/BlnjNo, or until a new control action is determined necessary by the balance control process.

Given FlnjNo, BlnjNo, the front and back mass-increment per control actuator action, and the parameters of equation 13, we can find the desired $FThrNo_0$ and $BThrNo_0$, and the corresponding ThrNo. After that, FThrNo and BThrNo are updated as discussed herein. The ratios of equation 15 must be considered.

*FlnjNo/BlnjNo*=Real value that varies from 0 to ∞ as control action conditions change from all control actuator actions in the back to all control actuator action in the front control plane.

FThrNo/ThrNo=Discrete increments of 1/ThrNo ranging in value from 0 to 1 as the partitions of control actuator actions in ThrNo shift from all in the back to all in the front control plane.

BThrNo/ThrNo=Discrete increments of 1/ThrNo ranging in value from 0 to 1 as the partitions of control actuator actions in ThrNo shift from all in the front to all in the back control plane. (15)

Temporarily assume that the later two ratios can take on any positive real value in the established range, versus discrete increments of 1/ThtNo. By simply reassigning some variables, as shown in equation 16, a relationship can be established between FlnjNo/BlnjNo and FThrNo/ThrNo or between FlnjNo/BlnjNo and BThrNo/ThrNo, as shown in equations 17 through 20.

$$y=\frac{FlnjNo}{BlnjNo}=\text{Desired proportion to maintain throughout the full control action} \quad (16)$$

$$x=\frac{FThrNo}{ThrNo}=\text{Proportion of front to total actuations in a force-limited set}$$

-continued $$z = \frac{BThrNo}{ThrNo} = \text{Proportion of back to total actuations in a force-limited set}$$

$$y = \frac{FlnjNo}{BlnjNo} \approx \frac{FThrNo}{BThrNo} = \frac{FThrNo}{(ThrNo - FThrNo)} = \frac{\frac{FThrNo}{ThrNo}}{\frac{(ThrNo - FThrNo)}{ThrNo}} = \frac{x}{(1-x)} \tag{17}$$

$$y = \frac{FlnjNo}{BlnjNo} \approx \frac{FThrNo}{BThrNo} = \frac{(ThrNo - BThrNo)}{BThrNo} = \frac{\frac{(ThrNo - BThrNo)}{ThrNo}}{\frac{BThrNo}{ThrNo}} = \frac{(1-z)}{z} \tag{18}$$

Rearranging terms in equations 17 and 18 results in the relations of equations 19 and 20, providing a simple mathematical relation involving both the ratios of equation 15 and the force limits of equation 14.

$$x = \frac{y}{1+y} \tag{19}$$

$$z = \frac{1}{1+y} \tag{20}$$

Consider equation 19 above, such that if the ratio FlnjNo/BlnjNo is provided, then the value of y is known and the value of x can be computed. This value of x, along with the previously determined ThrNo, can then be used with equation 16 to compute FThrNo, which is thereafter subtracted from ThrNo to obtain BThrNo. Recall, however, it was assumed that x could be any real positive value, when in reality x takes on discrete values in increments of 1/ThrNo ranging in value from 0 to 1. To resolve this, simply determine x from the known y value, and then round x to its nearest discrete value, x', before determining FThrNo and BThrNo.

Once FThrNo and BThrNo are determined from x', they can be applied against the total desired control action. Given improved balance conditions, this desired control action can be continued by establishing a new value for y, $y_1$, that is based on the number of actuator steps remaining in the desired action. From the new y value, $y_1$, a new x value, $x_1$, can be determined and rounded to the nearest value $x_1'$, as shown in equations 21 and 22.

$$y_1 = \frac{(FlnjNo - FThrNo)}{(BlnjNo - BThrNo)} \tag{21}$$

$$x_1 = \frac{y_1}{1+y_1} \tag{22}$$

$$x_1' = \text{Nearest_Discrete_Value}(x_1)$$

leading to the next force-limited set of control actuator actions to be applied against the total desired control action, $FThrNo_1$ and $BThrNo_1$. This evolution of control actuator sets continues until the total control action is accomplished or until a new control action is determined necessary.

FIG. 8 illustrates a table 350 illustrating a simultaneous dual-actuator algorithm implementation, in accordance with preferred embodiments of the present invention. Those skilled in the art can appreciate that table 350 and the values and parameters indicated therein represent merely one example of a multi-actuator algorithm in accordance with preferred embodiments of the present invention. Other algorithmic implementations may also be utilized in accordance with the present invention. Table 350 is based on the illustrative parameters in equation 23.

$$FlnjNo=22$$

$$BlnjNo=4$$

$$ThrNo=5 \tag{23}$$

Column 352 represents values for the front control plane of a rotating system. Column 354 represents values for the back control plane of the rotating system. Column 356 represents y values, while columns 358 and 360 respectively represent x and x' parameters. Column 362 lists FThrNo values, while column 364 represents BThrNo values. Those skilled in the art can appreciate that initially desired actions and threshold-limited actions are designated and thereafter incremented to a "next desired action" and "next force-limited action" until values of 0 are achieved.

The method can be further generalized for the case of more than two control planes with associated control actuators. The variables of equation 14 take on the general form of equation 24.

$n$=Number of control actuators $lnjNo(i)$=Number of control actuator $i$ steps for desired control action $ThrNo(i)$=Number of control actuator $i$ steps in the force-limited set $$ThrNo = \sum_n ThrNo(i)_0 = \text{Total number of actuator steps in desired force-limited set} \tag{24}$$

The ratios of equation 15 are more generally represented by equation 25.

$$\frac{InjNo}{\sum_{j=i+1}^{n} InjNo(j)} = \text{Real value that varies from 0 to } \infty \tag{25}$$

as control action conditions change from no control actuator $i$ actions to all control actuator $i$ actions.

$$\frac{ThrNo(i)}{ThrNo - \sum_{j=1}^{i-1} ThrNo(j)} = \text{Discrete value ranging from 0 to 1}$$

as actuator $i$ contribution to remaining force-limited set actuations ranges from nothing to fully contributing.

The reassignment of variables in equation 16 becomes that shown in equation 26 and the relationships of equations 17 and 19 become those of equations 27 and 28.

$$y(i) = \frac{InjNo(i)}{\sum_{j=i+1}^{n} InjNo(j)} = \text{Desired proportion to maintain throughout the full control action} \quad (26)$$

$$x(i) = \frac{ThrNo(i)}{ThrNo - \sum_{j=1}^{i-1} ThrNo(j)} = \text{Proportion of } i \text{ to total remaining actions in a force-limited set}$$

$$y(i) = \frac{InjNo(i)}{\sum_{j=i+1}^{n} InjNo(j)} \approx \frac{ThrNo(i)}{\sum_{j=i+1}^{n} ThrNo(j)} \quad (27)$$

$$= \frac{ThrNo(i)}{\left(ThrNo - \sum_{j=1}^{i-1} ThrNo(j)\right) - ThrNo(i)}$$

$$= \frac{\dfrac{ThrNo(i)}{\left(ThrNo - \sum_{j=1}^{i-1} ThrNo(j)\right)}}{\dfrac{\left(ThrNo - \sum_{j=1}^{i-1} ThrNo(j)\right) - ThrNo(i)}{\left(ThrNo - \sum_{j=1}^{i-1} ThrNo(j)\right)}} = \frac{x(i)}{1 - x(i)}$$

$$x(i) = \frac{y(i)}{1 + y(i)} \quad (28)$$

Generalizing the method described for equation 19 through 22, the relations of equations 24 through 28 are progressively applied to actuator 1 through n−1. The value of x(i) can be rounded to the nearest increment of $$1 \Big/ \left(ThrNo - \sum_{j=1}^{i-1} ThrNo(j)\right)$$

to obtain x'(i), which is then used in equation 26 to determine ThrNo(i), with ThrNo(n) assigned the remaining actuations in the force-limited set. This is then iterated as control sets are applied against the total control action as described in the earlier simple case.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered. The description as set forth is not intended to be exhaustive or to limit the scope of the invention. For example, those skilled in the art can appreciate that the methods described herein, including mathematical formulations, can be implemented as a program product in the form of varying software modules, routines, and subroutines. Many modifications and variations are possible in light of the above teaching without departing from the spirit and scope of the following claims. It is contemplated that the use of the present invention can involve components having different characteristics. It is intended that the scope of the present invention be defined by the claims appended hereto, giving full cognizance to equivalents in all respects.

The embodiments of an invention in which an exclusive property or right is claimed are defined as follows:

1. A method for dynamically balancing a rotating system based on a plurality of simultaneous and discrete control actions that place mass at predetermined locations within said rotating system, said method comprising the steps of:

providing a mass for placement at predetermined locations within said rotating system;

converting said mass into at least one set of discrete control actuator actions;

simultaneously activating a plurality of control actuators to deploy said at least one set of discrete control actuator actions in order to place mass at said predetermined locations within said rotating system; and applying said at least one set of discrete control actuator actions to said plurality of control actuators in order to place said mass at said predetermined locations within said rotating system to mimic a continuous application of said mass and smoothly place said rotating system in a balanced state and thereby mechanize said simultaneous control actuations within said rotating system.

2. The method of claim 1 wherein the step of providing a mass for placement at predetermined locations within said rotating system, further comprises the step of:

providing a mass for placement at predetermined locations within said rotating system, such that said mass comprises a mass per actuation for each actuator and a number of actuations per actuator in order to accomplish a complete control action.

3. The method of claim 1 wherein the step of converting said mass into at least one set of discrete control actuator actions, further comprises the steps of:

converting said mass into at least one set of discrete control actuator actions, such that each set of discrete control actuator actions is based on particular ratios;

evolving a composition of said at least one set of discrete control actuator actions, wherein said at least one set of discrete control actuator actions is based on prior applied sets of discrete control actuator actions that contribute to a total control action;

subjecting said at least one set of discrete control actuator actions to a force limit; and resolving ratios, evolutions, and limits thereof via a mathematical relation of said ratios and said force limit.

4. The method of claim 1 wherein said continuous application of said mass comprises:

a constant rate of mass placement versus a discrete set: and a constant proportion of mass placement between said plurality of control actuators versus evolved proportions constrained by discrete boundaries for actuator actions.

5. The method of claim 1 further comprising the steps of:

providing a mass for placement at predetermined locations within said rotating system, wherein said predetermined locations comprise front and back control planes of said rotating system; and retaining said mass locally within control planes so as to affect a point-mass contribution to said rotating system.

6. The method of claim 1 wherein said rotating system comprises a washing appliance.

7. The method of claim 6 wherein said washing appliance comprises a washing machine.

8. A method for dynamically balancing a rotating system based on a plurality of simultaneous and discrete control actions that place mass at predetermined locations within said rotating system, said method comprising the steps of:

providing a mass for placement at predetermined locations within said rotating system, such that said mass comprises a mass per actuation for each actuator and a number of actuations per actuator in order to accomplish a complete control action;

converting said mass into at least one set of discrete control actuator actions;

simultaneously activating a plurality of control actuators to deploy said at least one set of discrete control actuator actions in order to place mass at said predetermined locations within said rotating system; and applying said at least one set of discrete control actuator actions to said plurality of control actuators in order to place said mass at said predetermined locations within said rotating system to mimic a continuous application of said mass and smoothly place said rotating system in a balanced state and thereby mechanize said simultaneous control actuations within said rotating system.

9. A method for dynamically balancing a rotating system based on a plurality of simultaneous and discrete control actions that place mass at predetermined locations within said rotating system, said method comprising the steps of:

providing a mass for placement at predetermined locations within said rotating system, such that said mass comprises a mass per actuation for each actuator and a number of actuations per actuator in order to accomplish a complete control action;

converting said mass into at least one set of discrete control actuator actions, such that each set of discrete control actuator actions is based on particular ratios;

evolving a composition of said at least one set of discrete control actuator actions, wherein said at least one set of discrete control actuator actions is based on prior applied sets of discrete control actuator actions that contribute to a total control action;

subjecting said at least one set of discrete control actuator actions to a force limit;

resolving ratios, evolutions, and limits thereof via a mathematical relation of said ratios and said force limit; and simultaneously activating a plurality of control actuators to deploy said at least one set of discrete control actuator actions in order to place mass at said predetermined locations within said rotating system; and applying said at least one set of discrete control actuator actions to said plurality of control actuators in order to place said mass at said predetermined locations within said rotating system to mimic a continuous application of said mass and smoothly place said rotating system in a balanced state and thereby mechanize said simultaneous control actuations within said rotating system.

10. The method of claim 9 wherein said rotating system comprises a washing appliance.

11. A system for dynamically balancing a rotating system based on a plurality of simultaneous and discrete control actions that place mass at predetermined locations within said rotating device, said system comprising:

a mass placed at predetermined locations within said rotating device, wherein said mass is converted into at least one set of discrete control actuator actions;

a plurality of control actuators simultaneously activated to deploy said at least one set of discrete control actuator actions in order to place mass at said predetermined locations within said rotating device; and at least one set of discrete control actuator actions applied to said plurality of control actuators in order to place said mass at said predetermined locations within said rotating device to mimic a continuous application of said mass and smoothly place said rotating device in a balanced state and thereby mechanize said simultaneous control actuations within said rotating device.

12. The system of claim 11 wherein said mass comprises a mass per actuation for each actuator and a number of actuations per actuator in order to accomplish a complete control action.

13. The system of claim 11 wherein:

said mass is converted into at least one set of discrete control actuator actions, such that each set of discrete control actuator actions is based on particular ratios;

a composition of said at least one set of discrete control actuator actions is evolved, such that said at least one set of discrete control actuator actions is based on prior applied sets of discrete control actuator actions that contribute to a total control action;

said at least one set of discrete control actuator actions is subjected to a force limit; and wherein ratios, evolutions, and limits thereof are resolved via a mathematical relation of ratios and limits.

14. The system of claim 11 wherein said continuous application of said mass comprises:

a constant rate of mass placement versus a discrete set: and a constant proportion of mass placement between said plurality of control actuators versus evolved proportions constrained by discrete boundaries for actuator actions.

15. The system of claim 11 wherein:

said predetermined locations comprise front and back control planes of said rotating device; and wherein said mass is retained locally within control planes so as to effect a point-mass contribution to said rotating device.

16. The system of claim 11 wherein said rotating device comprises a washing appliance.

17. The system of claim 16 wherein said washing appliance comprises a washing machine.

18. A system for dynamically balancing a rotating device based on a plurality of simultaneous and discrete control actions that place mass at predetermined locations within said rotating device, said system comprising:

a mass placed at predetermined locations within said rotating device, such that said mass comprises a mass per actuation for each actuator and a number of actuations per actuator in order to accomplish a complete control action;

said mass converted into at least one set of discrete control actuator actions;

a plurality of control actuators simultaneously activated to deploy said at least one set of discrete control actuator actions in order to place mass at said predetermined locations within said rotating device; and wherein said at least one set of discrete control actuator actions applied to said plurality of control actuators in order to place said mass at said predetermined locations within said rotating device to mimic a continuous application of said mass and smoothly place said rotating device in a balanced state and thereby mechanize said simultaneous control actuations within said rotating device.

19. A system for dynamically balancing a rotating device based on a plurality of simultaneous and discrete control actions that place mass at predetermined locations within said rotating device, said system comprising:

a mass placed at predetermined locations within said rotating device, such that said mass comprises a mass per actuation for each actuator and a number of actuations per actuator in order to accomplish a complete control action;

said mass converted into at least one set of discrete control actuator actions, such that each set of discrete control actuator actions is based on particular ratios;

an evolved composition of said at least one set of discrete control actuator actions, wherein said at least one set of discrete control actuator actions is based on prior applied sets of discrete control actuator actions that contribute to a total control action;

said at least one set of discrete control actuator actions subjected to a force limit;

ratios, evolutions, and limits thereof resolved via a mathematical relation of said ratios and said force limit;

a plurality of control actuators simultaneously activated to deploy said at least one set of discrete control actuator actions in order to place mass at said predetermined locations within said rotating device; and said at least one set of discrete control actuator actions applied to said plurality of control actuators in order to place said mass at said predetermined locations within said rotating device to mimic a continuous application of said mass and smoothly place said rotating device in a balanced state and thereby mechanize said simultaneous control actuations within said rotating device.

20. The system of claim 19 wherein said rotating device comprises a washing appliance.

* * * * *